US008091383B1

(12) United States Patent
Zahiri et al.

(10) Patent No.: US 8,091,383 B1
(45) Date of Patent: Jan. 10, 2012

(54) TWO FINGER RING AND TWO TOE RING

(76) Inventors: Robabah Kasravi Zahiri, Los Angeles, CA (US); Hormoz Zahiri, Los Angeles, CA (US)

( * ) Notice: Subject to any disclaimer, the term of this patent is extended or adjusted under 35 U.S.C. 154(b) by 0 days.

(21) Appl. No.: 11/209,480

(22) Filed: Aug. 22, 2005

(51) Int. Cl.
*A44C 9/00* (2006.01)

(52) U.S. Cl. ..... 63/15; D11/26

(58) Field of Classification Search ..... 63/15, 15.9, 63/15.7, 15.8, 11, 10, 15.1, 15.2, 15.3, 15.4, 63/15.45, 15.5, 15.6, 15.65; D24/192, 190; D11/26, 88
See application file for complete search history.

(56) References Cited

U.S. PATENT DOCUMENTS

| | | | | | |
|---|---|---|---|---|---|
| 1,285,473 | A | * | 11/1918 | Tripp | 294/25 |
| 1,724,129 | A | * | 8/1929 | Cramer | 63/15.1 |
| 2,163,012 | A | * | 6/1939 | Schenk | 602/30 |
| 2,471,997 | A | * | 5/1949 | Baltor | 602/30 |
| 3,234,936 | A | * | 2/1966 | Levitt | 602/30 |
| 3,360,959 | A | * | 1/1968 | Schechter et. al. | 63/15.6 |
| 3,385,079 | A | * | 5/1968 | Von Hollen | 63/15 |
| 3,712,271 | A | * | 1/1973 | Greathouse | 119/770 |
| 3,724,458 | A | * | 4/1973 | Piper | 602/79 |
| 4,043,145 | A | * | 8/1977 | Chervin | 63/15 |
| 4,096,710 | A | * | 6/1978 | Sloan | 63/15.9 |
| 4,362,031 | A | * | 12/1982 | Obermuller | 63/15 |
| D305,214 | S | * | 12/1989 | Campbell | D11/26 |
| D309,276 | S | * | 7/1990 | Mejias | D11/26 |
| 5,275,019 | A | * | 1/1994 | Pagani | 63/15 |
| D489,458 | S | * | 5/2004 | Joseph | D24/192 |
| D494,276 | S | * | 8/2004 | Joseph | D24/192 |
| 7,017,369 | B2 | * | 3/2006 | Roberts-Shea | 63/15 |
| D560,854 | S | * | 1/2008 | Anderson et al. | D28/59 |
| 2005/0268653 | A1 | * | 12/2005 | Kaplan | 63/15.7 |

* cited by examiner

*Primary Examiner* — Jack W. Lavinder
(74) *Attorney, Agent, or Firm* — Thomas I. Rozsa

(57) ABSTRACT

A significant improvement in ring designs which greatly increases the size of the ring in order to accommodate larger ornamentation such as stones incorporated into the ring. The present invention achieves its improved design by making the ring large enough so that it encircles two adjacent fingers of a hand or two adjacent toes of a foot, thereby increasing the size of the ring so that it can accommodate larger ornamentation such as large stones.

11 Claims, 4 Drawing Sheets

TWO FINGER RING AND TWO TOE RING

BACKGROUND OF THE INVENTION

1. Field of the Invention

The present invention relates to the field of jewelry and more particularly, to rings which are made of any material and which may also include ornaments such as stones.

2. Description of the Prior Art

In general, rings have been in existence for a very long time. The rings which have been made are designed to encircle one finger of a hand or of a toe. As a result, the circumference of the ring is limited by the size of the wearer's finger or toe in which the ring is to be worn. In addition, the length of the ring is limited by the distance from the base of the finger to the first knuckle. In other words, the ring is limited by the length of the proximal phalanx of the finger or toe. As a result, the size of any ornamentation such as precious stones which are incorporated into the ring is limited by the size of the ring.

With rings of the design known in the prior art, very large stones cannot be incorporated into the ring because of the limitation on the size of the ring based on the size of the wearer's finger and the distance from the base of the finger or toe to the first knuckle (length of the proximal phalanx).

There is a significant need for an improved ring design which can increase the size of the ring in order to accommodate larger stones and other ornamentation to be worn in the ring.

SUMMARY OF THE INVENTION

The present invention is a significant improvement in ring designs which greatly increases the size of the ring in order to accommodate larger ornamentation such as stones incorporated into the ring. The present invention achieves its improved design by making the ring large enough so that it encircles two adjacent fingers of a hand or two toes of the feet, thereby increasing the size of the ring so that it can accommodate larger ornamentation such as large stones.

It has been discovered, according to the present invention, that if the ring is sized so that it encircles two adjacent fingers of a hand or two adjacent toes of a foot, then the increased size of the ring enables larger ornamentation such as larger stones to be incorporated into the ring. As a result, the wearer can wear very large stones on the wearer's hand or feet.

It has further been discovered, according to the present invention, that if the interior dimension of the ring is sized so that it encircles two adjacent fingers or toes and is sized in the lengthwise direction to be no longer than the distance between the base and first knuckle of the shorter of the two fingers or toes on which it is to be worn, then the two finger ring will fit firmly on both adjacent fingers or toes.

It has additionally been discovered, according to the present invention, that the concept of the two finger ring can be worn on any adjacent two fingers of the hand such as the pinkie and ring finger, the ring finger and middle finger, and the middle finger and forefinger of both the left hand and the right hand or on any two adjacent toes.

It has also been discovered, according to the present invention, that with the enlarged two finger ring or two toe ring, an ornamentation can be sized to also cover both fingers or both toes so that a stone, either precious or imitation, can be made large enough to cover both adjacent fingers of a hand or both adjacent toes of a foot.

It is therefore an object of the present invention to create a ring which can encircle two adjacent fingers of a hand or toes of a footso that large ornamentation such as larger stones can be incorporated into the ring.

It is therefore an object of the present invention to create a ring which can fit snugly around two adjacent fingers of a hand or two adjacent toes of a foot.

It is also an additional object of the present invention to create a ring which can be worn around any two adjacent fingers of either the left hand or the right hand or two adjacent toes of a left foot ro a right foot.

It is also an object of the present invention to create a two finger ring which can accommodate large ornamentation such as larger stones which can cover both adjacent fingers of a hand or both adjacent toes of a foot.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention two finger ring is illustrated in three different embodiments to be worn on three different pairs of adjacent two fingers of a hand and is also illustrated with three different band designs. It will be appreciated that other variations of band designs are also within the spirit and scope of the present invention two finger ring.

The concept of the present invention is to have a ring with a band that is sized to encircle two adjacent fingers of a hand so that the enlarged band can accommodate and support a large ornamentation such as one or more stones, pearls, and other ornamentation incorporated into the design of a ring.

Figure 1:
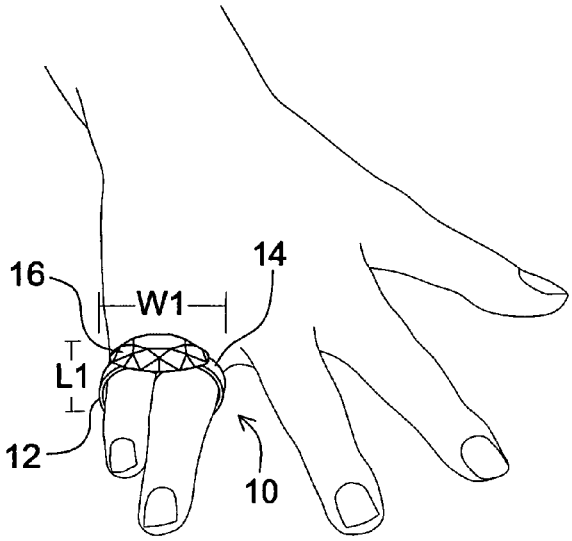
FIG. 1 is a perspective view of one embodiment of the present invention two finger ring, encircling the pinkie finger and ring finger of a hand.

Referring to FIG. 1, there is illustrated a first embodiment of the present invention two finger ring 10 having a band 12 which encircles the pinkie finger and the ring finger so that its width W1 extends the width of the pinkie and the ring fingers and its length L1 can be no greater than the distance from the base of the pinkie to the first knuckle of the pinkie finger. The upper surface 14 of band 12 can therefore accommodate a large ornamentation 16 such as a stone which is sufficiently large to cover both the pinkie and the ring fingers. Therefore, through the present invention, very large beautiful stones which are much larger than the stones of a one finger ring can be accommodated. It will be appreciated that the ornamentation can be any other ornamentation can be any other object incorporated into rings such as pearls, cloisonne, etc.

Figure 2:
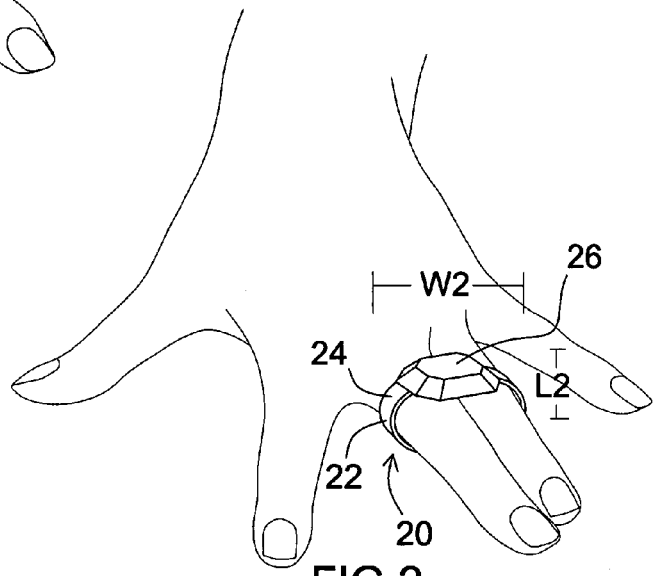
FIG. 2 is a perspective view of a second embodiment of the present invention two finger ring, encircling the ring finger and middle finger of a hand.

Referring to FIG. 2, there is illustrated a second embodiment of the present invention two finger ring 20 having a band 22 which encircles the ring finger and middle finger so that its width W2 extends the width of the ring finger and middle finger and its length L2 can be no greater than the distance from the base of the ring finger to the first knuckle of the ring finger. The upper surface 24 of band 22 can therefore accommodate a large ornamentation 26 such as a stone which is sufficiently large to cover both the ring finger and the middle finger.

Figure 3:
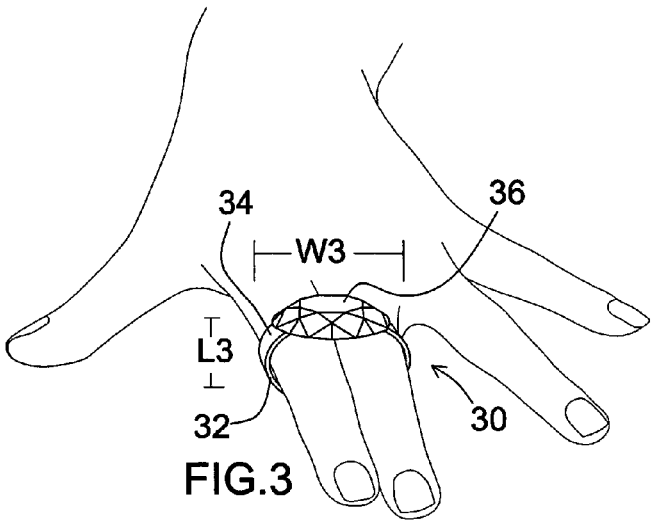
FIG. 3 is a perspective view of a third embodiment of the present invention two finger ring, encircling the middle finger and forefinger of a hand.

Referring to FIG. 3, there is illustrated a third embodiment of the present invention two finger ring 30 having a band 32 which encircles the middle finger and the forefinger so that its width W3 extends the width of the middle finger and the forefinger and its length L3 can be no greater than the distance from the base of the forefinger to the first knuckle of the forefinger. The upper surface 34 of band 32 can therefore accommodate a large ornamentation 36 such as a stone which is sufficiently large to cover both the middle finger and the forefinger.

Figure 4:
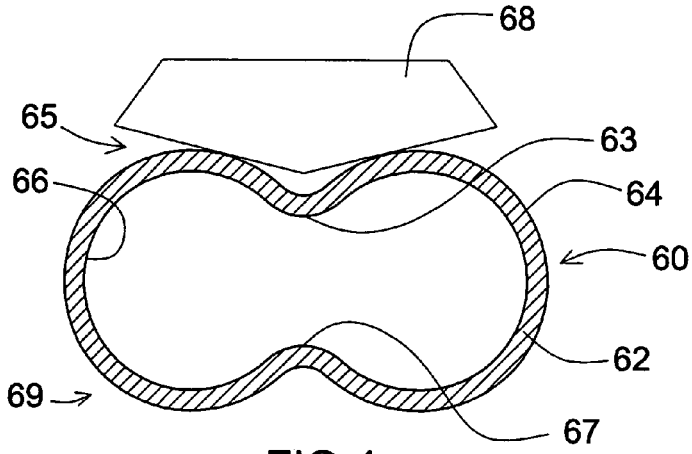
FIG. 4 is a cross-sectional view of one interior design embodiment of the present invention two finger ring.
Figure 5:
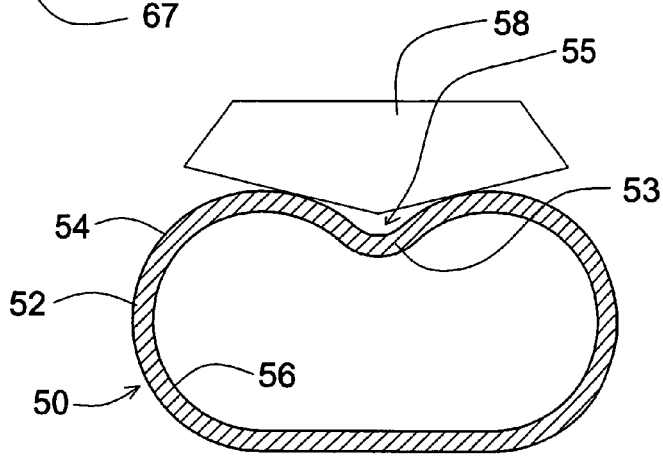
FIG. 5 is a cross-sectional view of a second interior design embodiment of the present invention two finger ring.
Figure 6:
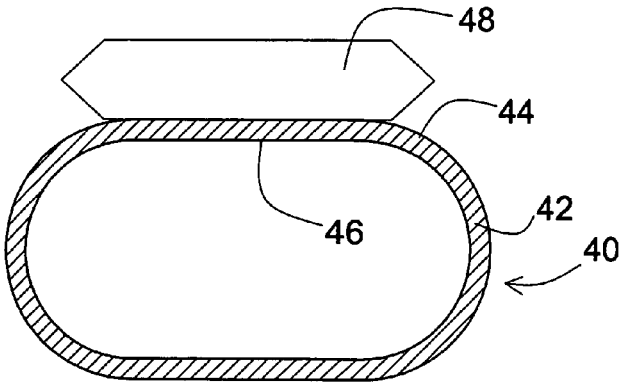
FIG. 6 is a cross-sectional view of a third interior design embodiment of the present invention two finger ring.

The concept of a ring encircling two adjacent fingers can have many variations, of which three representative examples are illustrated in FIGS. 4 through 6. The simplest variation is illustrated in FIG. 6 wherein the two finger ring 40 has a band 42 which is oval in shape on both the outer surface 44 and interior surface 46. The size of the interior surface 46 is sized to accommodate two adjacent fingers as illustrated in FIGS. 1 through 3.

The alternative variation of the two finger ring is illustrated in FIG. 5 wherein the two finger ring 50 has a band 52 which is generally oval in shape with an interior depression 53 at the approximate center of the upper portion 55 of band 52 with the outer surface 54 and interior surface 56 also having the depression 53 which enables the two finger ring to fit more snugly on two adjacent fingers. The depression 53 is located between the two adjacent fingers.

Another alternative variation of the two finger ring is illustrated in FIG. 4 wherein the two finger ring 60 has a band 62 which is generally oval in shape with an upper interior depression 63 at the approximate center of the upper portion 65 of band 62 and a lower interior depression 67 at the approximate center of the lower portion 69 of band 62 with the outer surface 64 and interior surface 66 also having the depressions 63 and 67 which enable the two finger ring to fit more snugly on two adjacent fingers. The depressions 63 and 67 are located between two adjacent fingers.

For each of the variations shown in FIGS. 6, 5 and 4, the ornamentations 48, 58 and 68 are on the upper surface and are large enough to cover the two adjacent fingers.

It will be appreciated that numerous other variations on the design of the two finger ring are within the spirit and scope of the present invention.

While one large stone has been illustrated, it will be appreciated that the two finger ring can accommodate any multiplicity and variation of ornamentation such as imitation and precious stones such as diamonds rubies, emeralds, sapphires, etc. or pearls or cloisonne or any other type of decoration.

It will be appreciated that the present invention also includes a decorative band which surrounds two adjacent fingers and does not have any ornamentation supported thereon.

The band of the present invention can be made of any material including, but not limited to, precious metals such as gold and silver, non-precious metals, or any other formable material such as plaster or wood.

While primarily intended for the fingers of a hand, the present invention can also be used to encircle two adjacent toes.

The concept of the present invention is also to have a ring with a band that is sized to encircle two adjacent toes of a foot so that the enlarged band can accommodate and support a large ornamentation such as one or more stones, pearls, and other ornamentation incorporated into the design of a ring.

Figure 7:
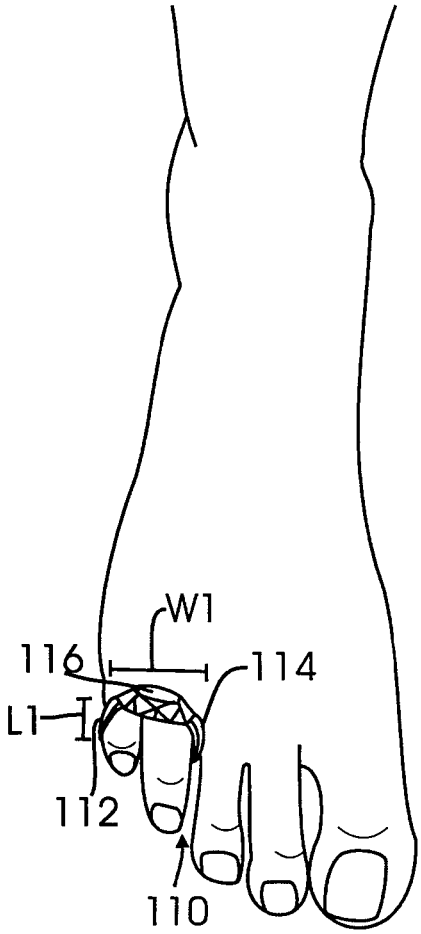
FIG. 7 is a perspective view of one embodiment of the present invention two toe ring, encircling the small toe and the adjacent toe of a foot.

Referring to FIG. 7, there is illustrated a first embodiment of the present invention two toe ring 110 having a band 112 which encircles the small toe and the fourth toe so that its width W1 extends the width of the small toe and the fourth toe and its length L1 can be no greater than the distance from the base of the small toe to the first knuckle of the small toe. The upper surface 114 of band 112 can therefore accommodate a large ornamentation 116 such as a stone which is sufficiently large to cover both the small toe and the fourth toe. Therefore, through the present invention, very large beautiful stones which are much larger than the stones of a one finger ring can be accommodated. It will be appreciated that the ornamentation can be any other object incorporated into rings such as pearls, cloisonne, etc.

Figure 8:
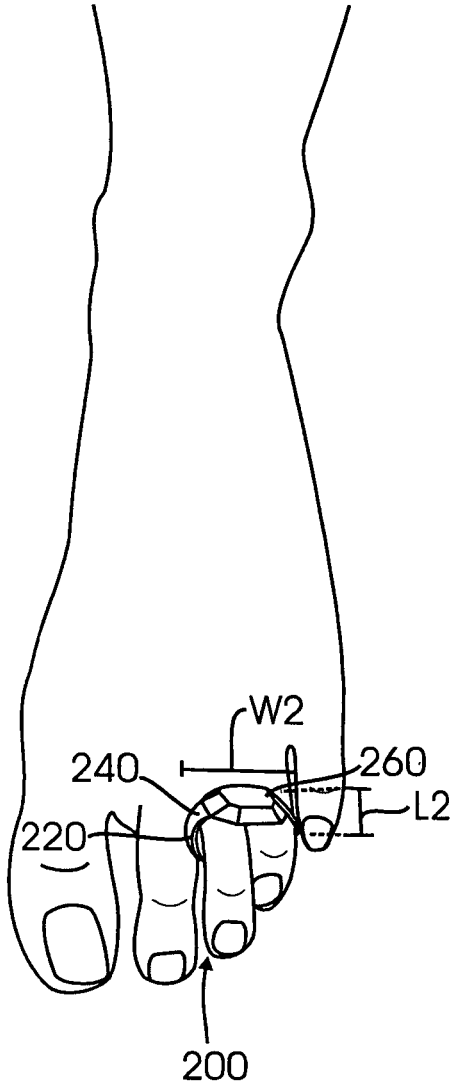
FIG. 8 is a perspective view of a second embodiment of the present invention two toe ring, encircling the fourth and third toes of a foot.

Referring to FIG. 8, there is illustrated a second embodiment of the present invention two finger ring 200 having a band 222 which encircles the fourth toe and the third toe so that its width W2 extends the width of the fourth toe and the third toe and its length L2 can be no greater than the distance from the base of the fourth toe to the first knuckle of the fourth toe. The upper surface 240 of band 220 can therefore accommodate a large ornamentation 260 such as a stone which is sufficiently large to cover both the fourth toe and the third toe.

Figure 9:
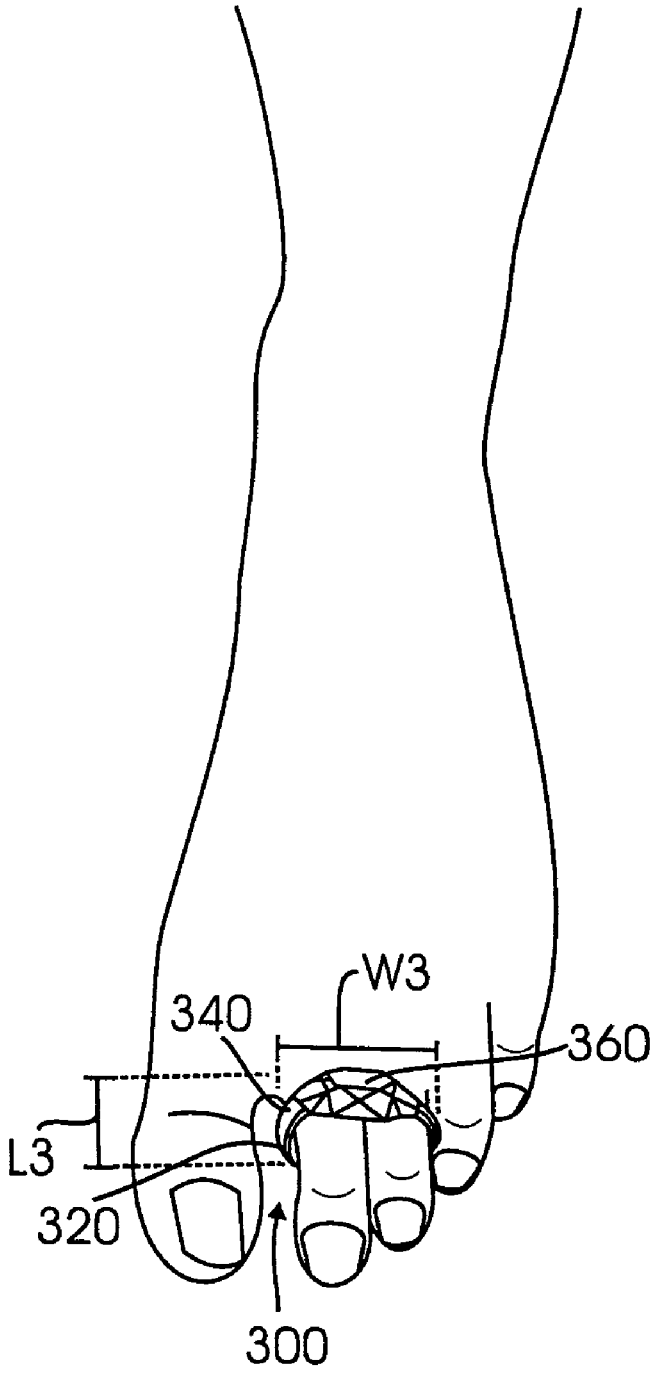
FIG. 9 is a perspective view of a third embodiment of the present invention two toe ring, encircling the third and second toes of a foot.

Referring to FIG. 9, there is illustrated a third embodiment of the present invention two toe ring 300 having a band 320 which encircles the third toe and the second toe so that its width W3 extends the width of the third toe and the second toe and its length L3 can be no greater than the distance from the base of the third toe to the first knuckle of the third toe. The upper surface 340 of band 320 can therefore accommodate a large ornamentation 360 such as a stone which is sufficiently large to cover both the middle finger and the forefinger.

The concept of a ring encircling two adjacent toes can have many variations, of which three representative examples are illustrated in FIGS. 4 through 6. The simplest variation is illustrated in FIG. 6 wherein the two toe ring 40 has a band 42 which is oval in shape on both the outer surface 44 and interior surface 46. The size of the interior surface 46 is sized to accommodate two adjacent toes as illustrated in FIGS. 7 through 9.

The alternative variation of the two toe ring is illustrated in FIG. 5 wherein the two toe ring 50 has a band 52 which is generally oval in shape with an interior depression 53 at the approximate center of the upper portion 55 of band 52 with the outer surface 54 and interior surface 56 also having the depression 53 which enables the two toe ring to fit more snugly on two adjacent toes. The depression 53 is located between the two adjacent toes.

Another alternative variation of the two toe ring is illustrated in FIG. 4 wherein the two toe ring 60 has a band 62 which is generally oval in shape with an upper interior depression 63 at the approximate center of the upper portion 65 of band 62 and a lower interior depression 67 at the approximate center of the lower portion 69 of band 62 with the outer surface 64 and interior surface 66 also having the depressions 63 and 67 which enable the two toe ring to fit more snugly on two adjacent toes. The depressions 63 and 67 are located between two adjacent toes.

For each of the variations shown in FIGS. 6, 5 and 4, the ornamentations 48, 58 and 68 are on the upper surface and are large enough to cover the two adjacent toes.

It will be appreciated that numerous other variations on the design of the two toe ring are within the spirit and scope of the present invention.

While one large stone has been illustrated, it will be appreciated that the two toe ring can accommodate any multiplicity and variation of ornamentation such as imitation and precious stones such as diamonds rubies, emeralds, sapphires, etc. or pearls or cloisonne or any other type of decoration.

It will be appreciated that the present invention also includes a decorative band which surrounds two adjacent toes and does not have any ornamentation supported thereon.

The band of the present invention can be made of any material including, but not limited to, precious metals such as gold and silver, non-precious metals, or any other formable material such as plaster or wood.

While the anterior of the band is generally oval shaped to surround two adjacent toes, the exterior surface of the band can be any desired shape.

Defined in detail, the present invention is a ring comprising: (a) a generally interiorly oval shaped band which is sized to surround two adjacent fingers of a hand, the width of the band being sufficiently wide to encircle two adjacent fingers and the length of the band being no longer than the distance from the base to the knuckle of the shorter of the two fingers; and (b) at least one ornamentation supported on said band, the ornamentation being of sufficient size to cover the two adjacent fingers.

Defined broadly, the present invention is a ring comprising a generally interiorly oval shaped band which is sized to support two adjacent fingers of a hand, the width of the band being sufficiently wide to encircle two adjacent fingers and the length of the band being no longer than the distance from the base to the knuckle of the shorter of the two fingers.

Defined alternatively, the present invention is a ring comprising: (a) a generally interiorly oval shaped band which is sized to surround two adjacent toes of a foot, the width of the band being sufficiently wide to encircle two adjacent toes and the length of the band being no longer than the distance from the base to the knuckle of the shorter of the two toes; and (b) at least one ornamentation supported on said band, the ornamentation being of sufficient size to cover the two adjacent toes.

Defined alternatively, the present invention is a ring comprising a generally interiorly oval shaped band which is sized to support two adjacent toes of a foot, the width of the band being sufficiently wide to encircle two adjacent toes and the length of the band being no longer than the distance from the base to the knuckle of the shorter of the two toes.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A ring to be used in conjunction with two adjacent fingers of a same hand, the same hand having a base and at least two fingers extending therefrom, each of the at least two fingers having at least one knuckle, comprising:

a. a band having a fixed non-adjustable shape made of a material of a width, a length, a size, an upper portion, a lower portion, a thickness, an interior surface, and an exterior surface, and sized and designed in a given shape so that the band is used in conjunction with two adjacent fingers of a hand to encircle the two adjacent fingers of the hand, the length of the band sized and designed to be used in conjunction with an upper area along the two adjacent fingers from a base to a first knuckle of a shorter of the two adjacent fingers, the band having symmetry along a vertical axis, the upper portion of the band designed and sized to be used in conjunction with the back of the hand, and the lower portion of the band designed and sized to be used in conjunction with the palm of the hand;

b. at least one depression, the depression designed and sized to be located centrally and approximately where the two adjacent fingers meet, to be used in conjunction with the location where the two adjacent fingers meet, and transversely across the length of the band and concavely, curving interiorly of the band, the thickness of the band between the interior surface and the exterior surface remaining constant, the at least one depression giving the band a kidney bean shape;

c. at least one large ornament having a length and a width, the length of the at least one ornament at least designed and sized to cover the length of the band, and the width of the at least one ornament designed and sized to at least partially cover the width of the band, the ornament large enough to cover two adjacent fingers of the same hand; and d. the length of the band and the width of the band and the ornament are designed and sized to be used in conjunction with two adjacent fingers of a hand so that the band completely covers an area of the shorter of the two adjacent fingers, from the base to a first knuckle.

2. The ring in accordance with claim 1, wherein said at least one depression is adjacent an upper portion of the band.

3. The ring in accordance with claim 1, wherein said at least one depression is adjacent a lower portion of the band.

4. The ring in accordance with claim 1, further comprising a first depression and a second depression, the first depression located adjacent an upper portion of the band and located centrally and approximately where the two adjacent fingers meet, the second depression located adjacent a lower portion of the band centrally and approximately where the two adjacent fingers meet, the two depressions giving the band a hourglass shape and also giving the band symmetry along a horizontal axis.

5. A ring to be used in conjunction with two adjacent toes of a same foot, the same foot having a base and at least two toes extending therefrom, each of the at least two toes having at least one knuckle, comprising:

a. a band having a fixed non-adjustable shape made of a material of a width, a length, a size, an upper portion, a lower portion, a thickness, an interior surface, and an exterior surface, and sized and designed in a given shape so that the band is used in conjunction with two adjacent toes of a foot, the length of the band sized and designed to cover an upper area along the two adjacent toes from a base to a first knuckle of a shorter of the two adjacent toes, the band having symmetry along a vertical axis, the upper portion of the band designed and sized to reside along the top of the foot, and the lower portion of the band designed and sized to reside along the sole of the foot;

b. at least one depression, the depression designed and sized to be located centrally and approximately where the two adjacent toes meet, and transversely across the length of the band and concavely, curving interiorly of the band, the thickness of the band between the interior surface and the exterior surface remaining constant, the at least one depression giving, the band a kidney bean shape;

c. at least one large ornament having a length and a width, the length of the at least one ornament at least designed and sized to cover the length of the band, and the width of the at least one ornament designed and sized to at least partially cover the width of the band, the ornament large enough to cover the two adjacent toes of the same foot; and d. the length of the band and the width of the band and the ornament are designed and sized to completely cover an area of the shorter of the two adjacent toes, from the base to a first knuckle.

6. The ring in accordance with claim 5, wherein said at least one depression is adjacent an upper portion of the band.

7. The ring in accordance with claim 5, wherein said at least one depression is adjacent a lower portion of the band.

8. The ring in accordance with claim 5, further comprising a first depression and a second depression, the first depression located adjacent an upper portion of the band and located centrally and approximately where the two adjacent toes meet, the second depression located adjacent a lower portion of the band centrally and approximately where the two adjacent toes meet, the two depressions giving the band a hourglass shape and also giving the band symmetry along a horizontal axis.

9. A ring to be used in conjunction with two adjacent fingers of a same hand, the same hand having a base and at least two fingers extending therefrom, each of the at least two fingers having at least one knuckle, comprising:

a. a band having a fixed non-adjustable shape made of a material of a width, a length, a size, an upper portion, a lower portion, a thickness, an interior surface, and an exterior surface, and sized and designed in a given shape so that the band is used in conjunction with two adjacent fingers of a hand to encircle the two adjacent fingers of the hand, the length of the band sized and designed to be used in conjunction with an upper area along the two adjacent fingers from a base to a first knuckle of a shorter of the two adjacent fingers, the band having symmetry along a vertical axis, the upper portion of the band designed and sized to be used in conjunction with the back of the hand, and the lower portion of the band designed and sized to be used in conjunction with the palm of the hand;

b. at least one depression, the depression designed and sized to be located centrally and approximately where the two adjacent fingers meet, to be used in conjunction with the location where the two adjacent fingers meet, and transversely across the length of the band and concavely, curving interiorly of the band, the thickness of the band between the interior surface and the exterior surface remaining constant, the at least one depression giving the band a kidney bean shape;

c. the length of the band being and the width of the band are designed and sized to be used in conjunction with two adjacent fingers of a hand so that the band completely covers an area of the shorter of the two adjacent fingers, from the base to a first knuckle; and d. a first depression and a second depression, the first depression located adjacent an upper portion of the band and located centrally and approximately where the two adjacent fingers meet, the second depression located adjacent a lower portion of the band centrally and approximately where the two adjacent fingers meet, the two depressions giving the band a hourglass shape and also giving the band symmetry along a horizontal axis.

10. The ring in accordance with claim 9, wherein said at least one depression is adjacent a upper portion of the band.

11. The ring in accordance with claim 9, wherein said at least one depression is adjacent a lower portion of the band.

* * * * *